US005339547A

United States Patent [19]

Fogel

[11] Patent Number: 5,339,547

[45] Date of Patent: Aug. 23, 1994

[54] DISPLAY DEVICE

[76] Inventor: Allan Fogel, 8318 NW. 55th Ct., Coral Springs, Fla. 33067

[21] Appl. No.: 1,305

[22] Filed: Jan. 6, 1993

[51] Int. Cl.[5] ..... G09F 1/10

[52] U.S. Cl. ..... 40/124.4; 40/642

[58] Field of Search ..... 40/124, 124.4, 373, 40/642, 651, 546; 248/371; 211/45, 44, 46

[56] References Cited

U.S. PATENT DOCUMENTS

| | | | |
|---|---|---|---|
| 183,335 | 10/1876 | Sitterley | 40/124 X |
| 1,360,548 | 11/1920 | Long . | |
| 1,977,466 | 10/1934 | Bohnke . | |
| 2,345,228 | 3/1944 | Babineau | 211/45 |
| 2,513,127 | 6/1950 | Wolters | 40/651 |
| 2,873,859 | 2/1959 | Gates . | |
| 3,179,479 | 4/1965 | Freedman | 40/124 X |
| 4,648,189 | 3/1987 | Michel | 40/546 |

OTHER PUBLICATIONS

Walter Drake, Co., Colorado Springs, Colo. Christmas 1992 Catalog, p. 81.

*Primary Examiner*—Kenneth J. Dorner
*Assistant Examiner*—Joanne Silbermann
*Attorney, Agent, or Firm*—Hoffmann & Baron

[57] ABSTRACT

A display device for attractively holding and displaying a plurality of greeting cards, photographs, sports memorabilia cards, and the like. It includes a solid object having predetermined dimensions and at least one planar upper surface. The planar surface has a plurality of slots extending fully across the planar surface. The slots have a width and depth suitable for holding a substantially self-supporting flat object at a substantially vertical orientation with regard to gravity. It also include a support to raise the planar surface at an incline, preferably from 5° to 30° from the horizontal. A plurality of these display devices can be connected to each other or juxtaposed, in modular fashion, along their sides or portions thereof.

16 Claims, 14 Drawing Sheets

DISPLAY DEVICE

BACKGROUND OF THE INVENTION

1. Field of the Invention

This invention relates to display devices which have longitudinal slots for attractively displaying or organizing a plurality of greeting cards, photographs, sports memorabilia cards, and the like.

2. Background of the Related Art

On holidays, birthdays or other special occasions, greeting cards are often lined up or strewn about a table. Often the greeting cards cannot be seen and are easily knocked down by a breeze or the slightest contact. A few industrious people may hang the greeting cards on a string attached to their ceiling like a wash line. In addition, photographs, recipes, sports memorabilia cards, and other items are often collected in albums, drawers, and boxes, never to be seen again. Although some special photographs and cards may be displayed in frames, that option is usually expensive and requires a lot of time and effort whenever the photograph being displayed is changed. Accordingly, there is a need for an attractive device for displaying simultaneously a variable number of greeting cards, photographs, sports memorabilia cards, and the like that can be easily rearranged and changed to suit the particular occasion or setting.

Various display devices are known for commercial and office use. However, none of these provides an apparatus which is both attractive and useful for displaying cards, photographs and sports memorabilia items. For example, U.S. Pat. No. 2,873,859 discloses an imprinter plate rack. The plate rack has two sets of parallel frame supports defining frame holding slots between them. These supports are positioned with each support progressively higher from the front to rear of the rack. The supports include a plurality of vertical substantially parallel slots for supporting each frame and a rectangular parallel strip between the sets of slots for labeling. This rack, however, would not be practical for retaining greeting cards and photographs since the parallel slots do not fully extend across the middle of the rack. The raised strip prevents cards of various size being disposed across the middle of the rack and would pose a problem when attempting to arrange greeting cards, photographs, sports memorabilia cards, and the like in any fashion other than straight rows up and down the side of the rack.

A commercial display device and shipping package is described in U.S. Pat. No. 1,977,466. The grid-like package is made from cardboard and includes a plurality of rectangular pocket-like compartments, each capable of holding a plurality of items, such as flower seed packages or other similarly packaged items. The package is useful for shipping and storing the items, and may be assembled for display. However, one disadvantage of this apparatus is that the packets being displayed must be the same size as, or smaller than, the particular pockets. In addition, the pockets hold the packages or items being displayed so that only the first item in each pocket is visible. This type of display may be useful in a commercial setting where a number of the same items, such as seeds, are being sold so that only the front package need be seen by the prospective purchaser. However, it would not allow for the attractive, simultaneous display of a variety of greeting cards, photographs, sports memorabilia cards, and the like, each of which might have a different size, shape, or ornamentation.

An index card holder having a plurality of parallel slots is disclosed in U.S. Pat. No. 1,360,548. The index card holder has a top and two side walls with a plurality of slots extending through the top wall and ending at progressively higher depths in the side walls to hold the cards in an inclined and stepped relation. All index cards must be wider than the width of the top wall, or they will fall through. In addition, the slots retain index cards at almost their entire height within the walls of the cardholder. Subsequent cards cannot be seen behind the first card except for the small portion which may extend from behind. Accordingly, the index card holder is not practical for attractively displaying greeting cards, sports memorabilia cards, photographs, and other such items.

Lastly, Applicant discloses a Solitaire Lap Board described as Model No. F7409 at Page 81 of the Christmas, 1992 catalog of Walter Drake Co., Colorado Springs, Colo. The Solitaire Lap Board has a plurality of parallel slots which terminate prior to the edge of the board. In addition, the Solitaire Lap Board has four compartment trays which are suitable for holding playing cards in horizontal stacks. The board is specifically adapted for playing the game of solitaire and comes with solitaire game instructions. The construction of the Solitaire Lap Board does not permit photographs or greeting cards that are to be inserted into the board and slid in from the side. Nor does this construction allow greeting cards, photographs and other cards to be supported with portions of these items extending beyond the edge of the board. Additionally, the Solitaire Lap Board does not include any means of supporting its top surface at an inclined position.

Accordingly, it the purpose of the present invention to provide a display device for attractively displaying a variety of greeting cards, photographs, sports memorabilia cards, and the like all of which can be easily rearranged and changed by the user to suit the occasion. Although many display devices are known for commercial and office use, none provides a device that has been specifically designed for displaying cards, photographs, sports memorabilia cards, and the like, and allowing simultaneous viewing of those items.

SUMMARY OF THE INVENTION

These and other purposes are achieved by the present invention which provides attractive display devices for displaying a plurality of greeting cards, photographs, sports memorabilia cards, and the like.

The preferred display device includes a solid object having predetermined dimensions with at least one substantially planar surface. The planar surface has a plurality of slots extending fully across the surface. The slots have a particular width and depth which are suitable for holding various substantially self-supporting flat objects or holders for such objects at a substantially vertical orientation with regard to gravity. It is preferred that the slots be oriented at an angle of from greater than 0° to about 5° towards the rear surface of the solid object, measured from the vertical orientation with regard to gravity, in order to allow the items being displayed to be angled slightly backwards. The slots can have a width of from about 0.5 mm to about 5 mm, preferably from about 1 mm to about 3 mm. The slots preferably have a depth of from about 1 mm to about 15 mm, depending on the thickness of the display device itself, preferably a depth of from about 2 mm to about 10 mm, and most preferably a depth of from about 3 mm to about 7 mm. The slots can be oriented on the planar surface randomly, in a desired design or pattern, or preferably substantially parallel to each other. The device can include as many slots as can fit on the planar upper surface, but preferably would include from about 5 to about 15 slots.

The shape of the solid object making up the display device can be rectangular, square, round, oval, curved, triangular, heart-shaped, polygonal, irregularly shaped, or any other shape desired for a particular occasion or setting. Preferably, however, the shape of the display device is rectangular. The preferred display device also includes supporting means so that the planar surface is placed at an incline from the horizontal orientation with regard to gravity. This allows cards or other such items in the rear of the display device to be viewed more easily than when the display device is at a horizontal orientation. Preferably, these supporting means may include support posts, hangers, bars, panels, blocks, tubes, or frames. Preferably, the supporting means places the planar surface of the display device at an incline from the horizontal of from about 1° to about 90°, as when, for example, the display device is hung by the wall. More preferably, however, the support places the planar upper surface of the display device at an angle of from about 5° to about 30° from the horizontal.

A preferred embodiment includes one or more support panels that insert into slots in the bottom surface of the solid object making up the display device, and which give the display device and the supporting means the appearance of being a single solid object. If support posts are used, they are connected to the bottom surface of the solid object making up the display device by any means desired, such as matching holes so that the support posts fit within those holes, or other suitable connectors.

The display devices of the present invention can include a plurality of these display devices connected to each other in a modular fashion, by at least one of their sides or portions thereof. Such modular connection may include panels, pins, slots, frames or other suitable means for interconnecting these display devices.

For a better understanding of the present invention, reference is made to the following description and accompanying figures, the scope of which is pointed out in the claims.

DETAILED DESCRIPTION OF THE INVENTION

Figure 1:
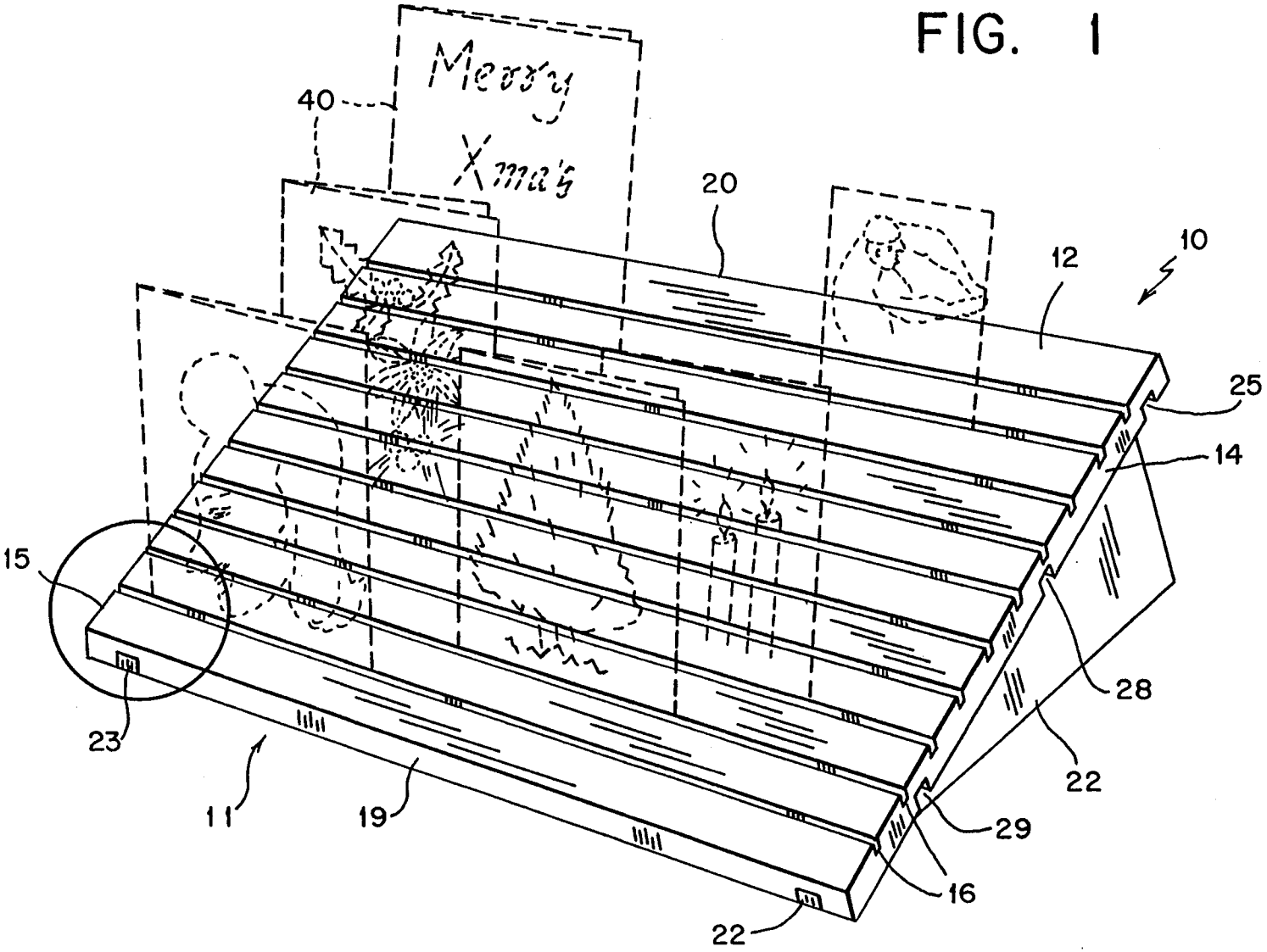
FIG. 1 is an elevated perspective view of the preferred display device in accordance with the present invention.
Figure 2:
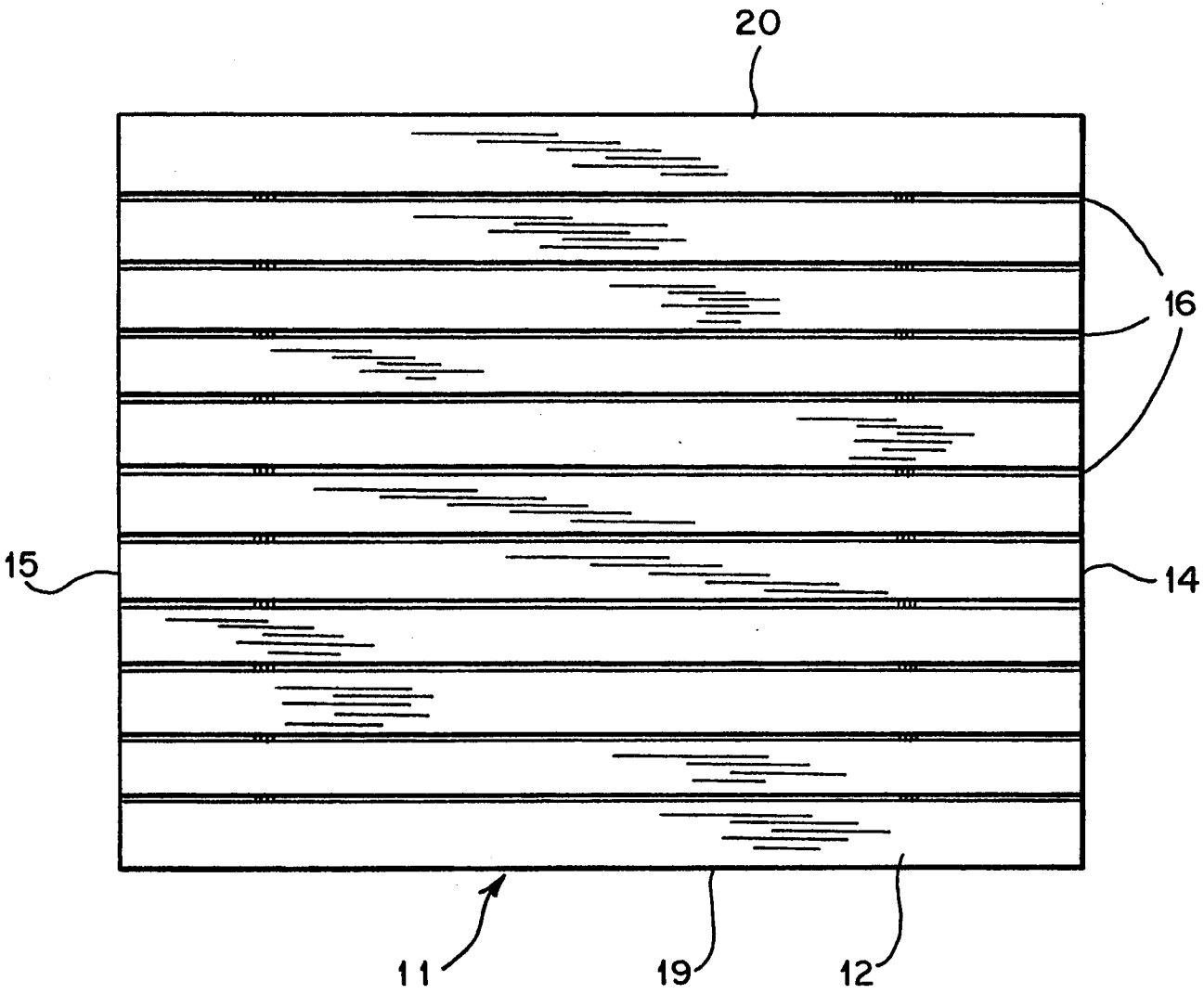
FIG. 2 is a top plan view thereof.
Figure 6:
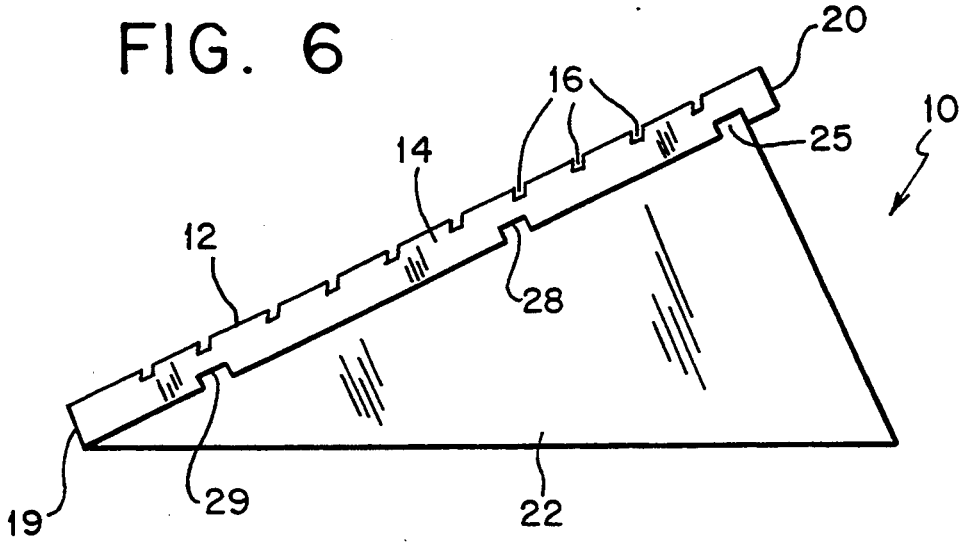
FIG. 6 is a right side elevational view thereof.

In accordance with the present invention, a preferred display device 10 is provided for displaying a plurality of photographs, greeting cards, sports memorabilia cards and the like.

As illustrated in FIGS. 1–21, a preferred display device 10 includes a base 11 having at least one substantially planar upper surface 12 with a plurality of longitudinal substantially parallel slots 16 extending across the entire width of the upper surface 12 of the base 11.

As illustrated in FIGS. 1, 3, 6, 7, 11, 13, 15, and 21, slots 16 are angled in relation to the base 11 so as to permit desirable insertion and display of various types and sizes of substantially self-supporting items 40, usually made of cardboard, plastic, paper, metal, or other material such as greeting cards, photographs, sports memorabilia and trading cards, photographic negatives and slides, post cards, recipe cards, index and file cards, membership cards, business cards, credit cards, compact discs, floppy discs, attendance cards, location or status cards, miscellaneous cards, specific industry or hobby cards, as well as any pre-existing or specifically designed holders to enhance the support or vary the display options of these items. The slots 16 extend downward from upper surface 12, and extend laterally to both the right side surface 14 and the left side surface 15 so that the slots are exposed at both ends allowing items 40 to be displayed extending beyond the edges of base 11. The preferred shape of the base 11 is rectangular, however, it can also be made in a shape that is square, round, oval, curved, triangular, heart-shaped, irregularly shaped, or base 11 may have any other desired shape.

There may be a few or many slots cut in upper surface 12 of the display base 11. The range of slots 16 may be from 1 to as many as can fit on the upper surface 12, preferably from about 5 to about 15 slots. It is preferred that the slots 16 are substantially parallel to each other, although the slots 16 may also be oriented in any direction and may be designed as random lines, or lines of a particularly desired design or pattern.

Figure 3:
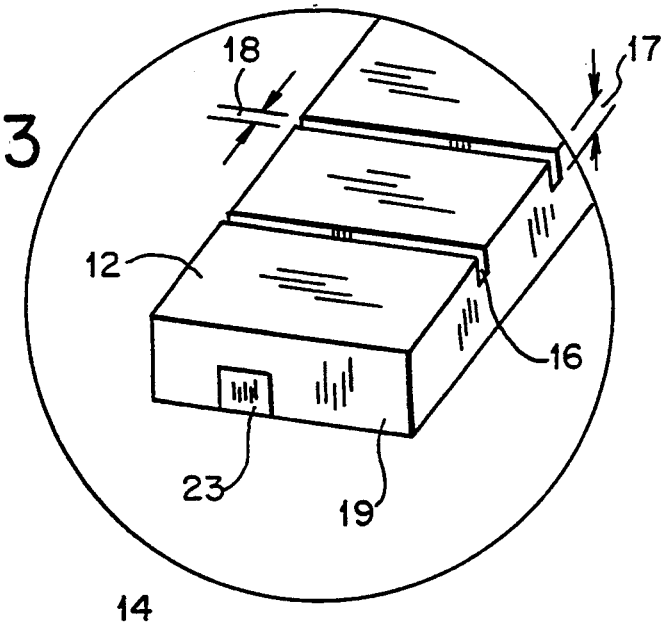
FIG. 3 is an enlarged partial cross-sectional view of the section circled in FIG. 1.
Figure 7:
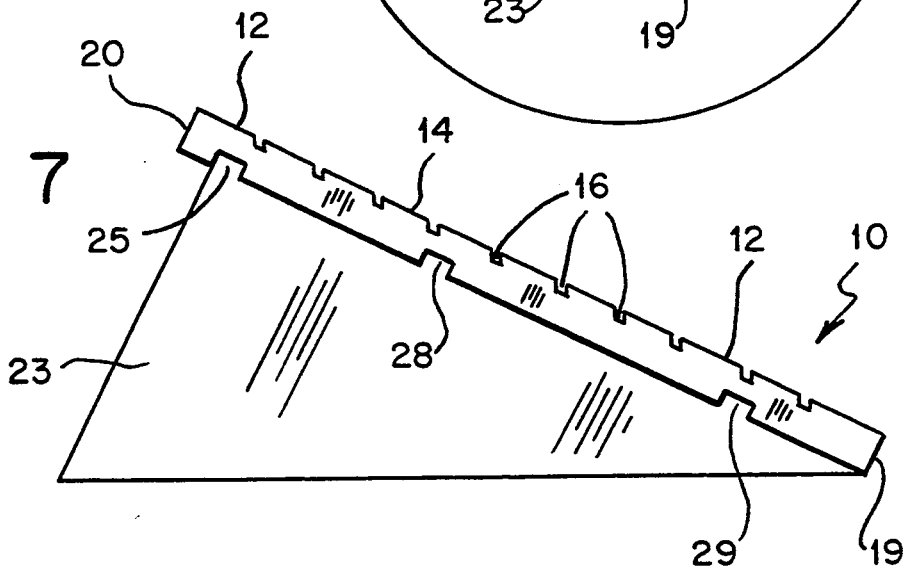
FIG. 7 is a left side elevational view thereof.
Figure 4:
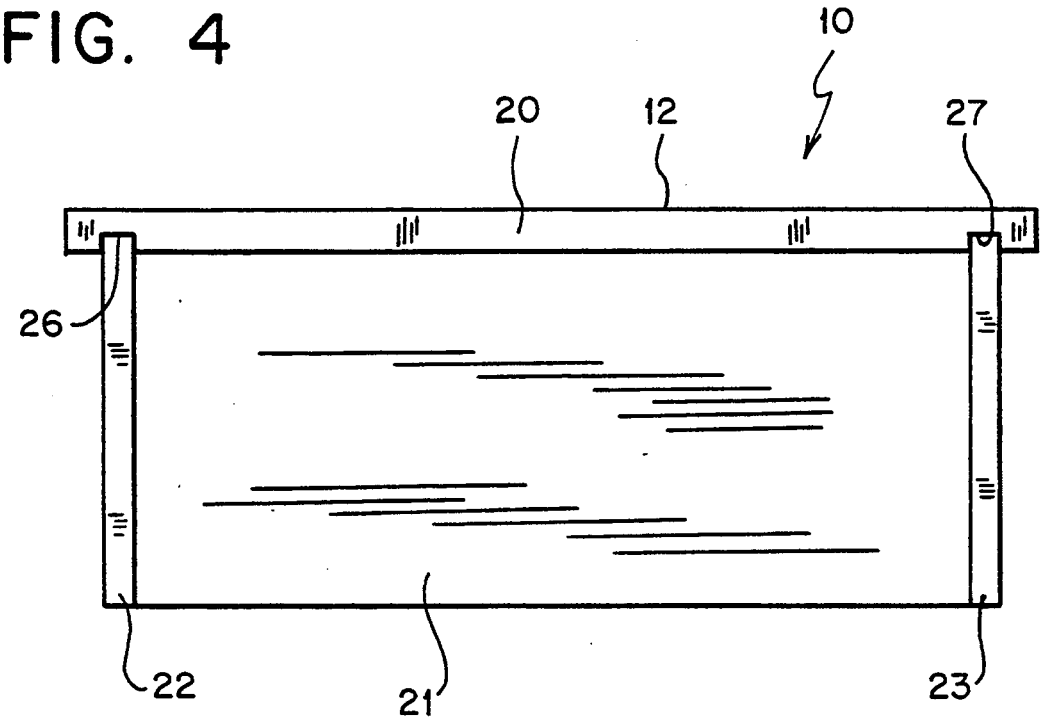
FIG. 4 is a rear elevational view thereof.
Figure 5:
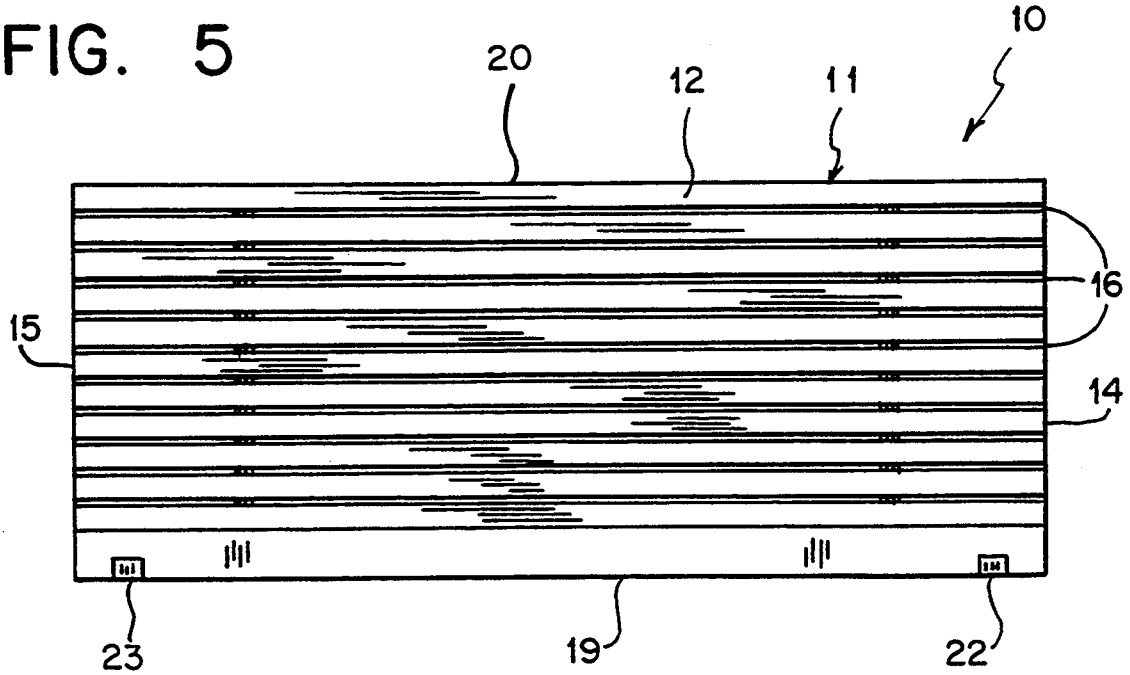
FIG. 5 is a front elevational view thereof.
Figure 8:
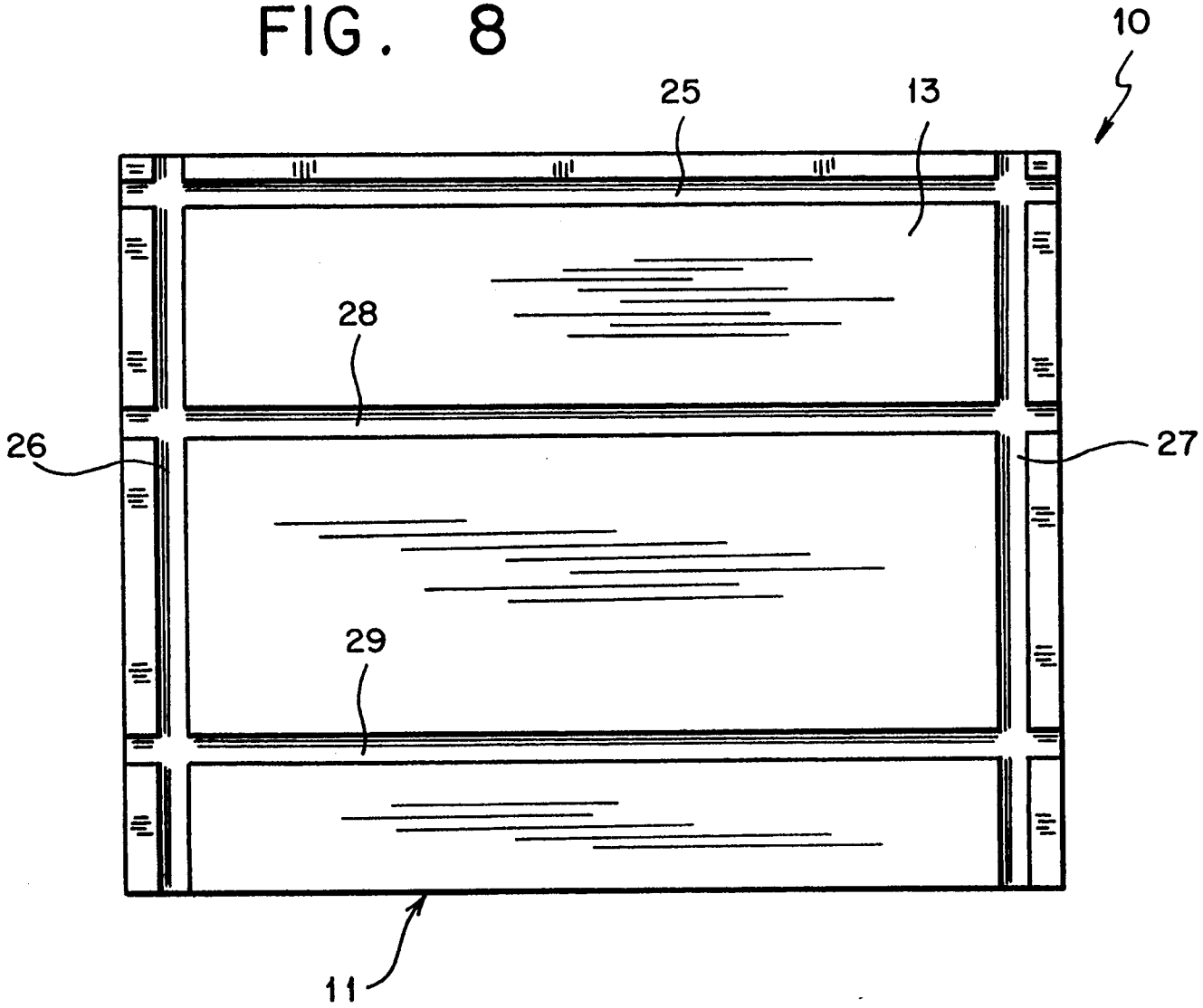
FIG. 8 is a bottom plan view of the display device illustrated in FIG. 1 having the support means unattached.
Figure 9:
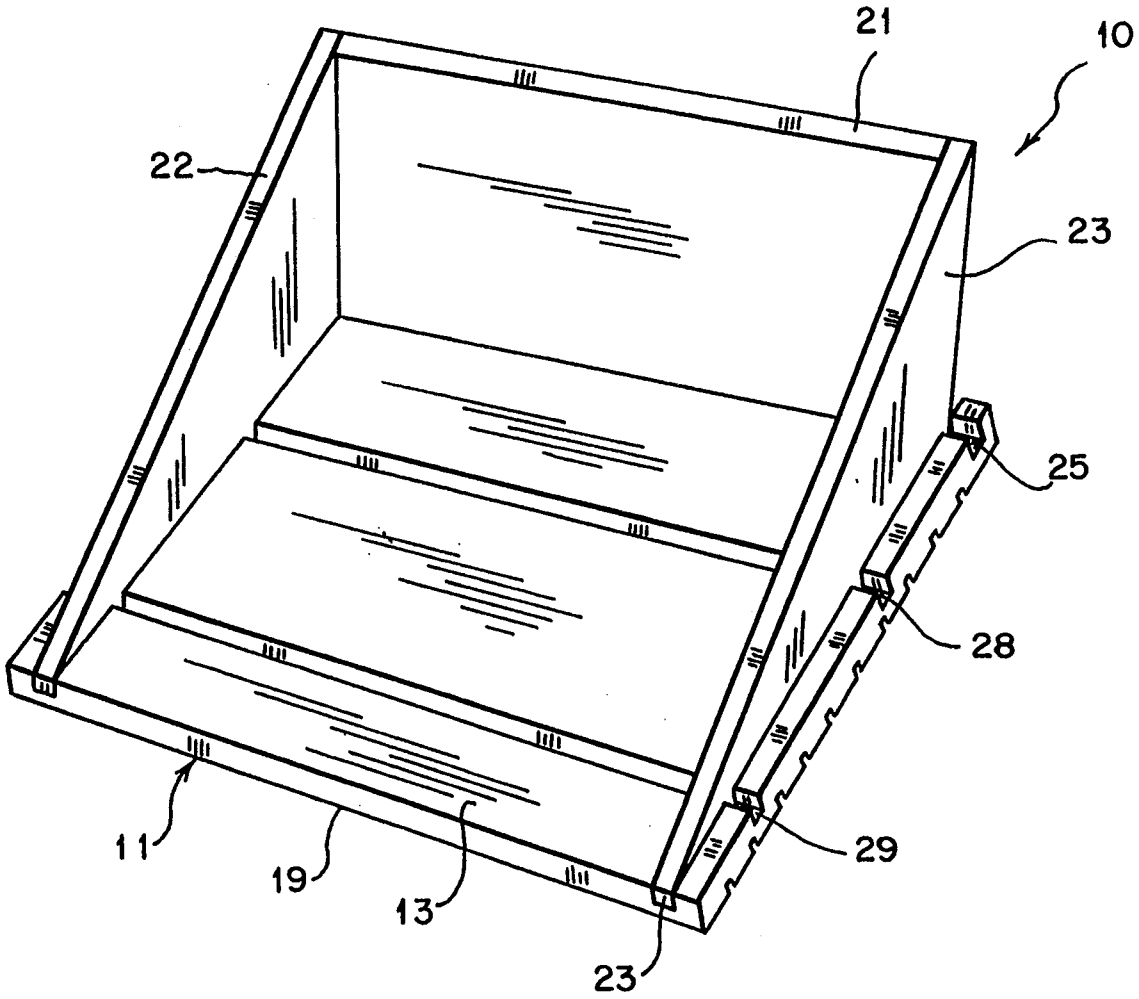
FIG. 9 is a bottom perspective view of a preferred display device illustrated in FIG. 1.
Figure 10:
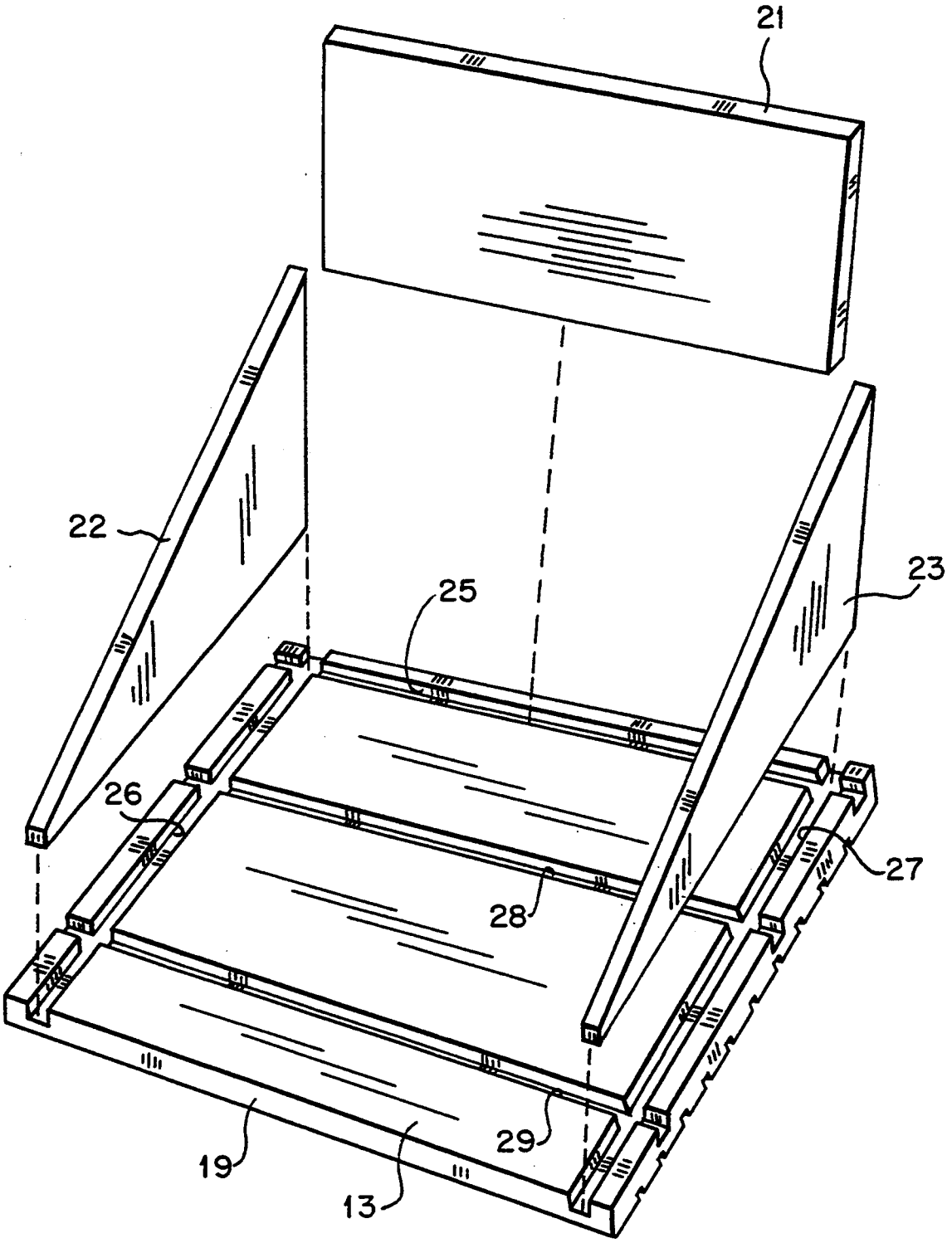
FIG. 10 is a bottom exploded perspective view thereof.

As illustrated in FIG. 3, slots 16 have a desired depth dimension 17 and a width dimension 18. The slot width 18 is sufficient to accommodate the thickness of typical greeting cards, sports memorabilia cards, photographs, and the like, in the range from about 0.5 mm to about 5 mm, preferably from about 1 mm to about 3 mm. The slot depth 17 must be sufficient to allow the walls of the slots to support the displayed item 40 parallel to gravity or at a desired angle from parallel, preferably from greater than 0° to about 5° towards rear surface 20, relative to the direction of gravity.

Accordingly, the depth 17 of slots 16 may vary, depending on the width 18 of the slots 16, from about 1 mm to 15 mm or more, limited by the thickness of base 11, the angle at which slots 16 are oriented, and the height of the items 40 to be displayed. The depth 17 of slots 16 is preferably from about 2 mm to about 10 mm, and most preferably from about 3 mm to about 7 mm.

As illustrated by FIGS. 1, 4, 6, 7, 9–15, support panels 21–23, posts 30, 31, or other support means including but not limited to hangers, bars or frames for placing the planar upper surface 12 of base 11 at an incline from the horizontal orientation with regard to gravity, from about 1° to about 90°, preferably from about 5° to about 30°, may advantageously be utilized with the present invention. When the base 11 is horizontal, the slots 16 in the upper surface 12 are preferably cut at an angle of about 90° relative to base 11, or a slightly more acute angle as measured towards the rear surface 20, to allow the items being displayed 40 to be angled slightly backwards. If the rear surface 20 of base 11 is to be raised, i.e. by the inclusion of support panels, posts, or other supporting means on its bottom surface 13, then slots 16 are preferably cut at a more acute angle, i.e. from about 90° minus (−) the angle of base 11 from a horizontal plane, as measured toward rear surface 20, to allow the items being displayed 40 to be displayed vertically. Desirably, slots 16 can be cut at a slightly more acute angle as measured towards the rear surface 22, so that the items being displayed 40 are angled slightly backwards. However, if means for supporting the display device 10 at steeper angles are used, then the angles of the slots 16 must be even more acute, depending on the desired display angle for items 40. In some instances, the display device 10 may be attached to a wall or other substantially vertical or angled surfaces and the slots 16 would suitably be cut to accommodate the particular angle of display.

In the preferred embodiment illustrated in FIGS. 1, 4, and 6–10, a planar rectangular panel 21 may be inserted into a linear slot 25, along the back edge 20 of the bottom surface 13 of the display base 11. Additionally, planar substantially triangular panels 22, 23 may be inserted into linear slots 26, 27 along the longitudinal edges 14, 15 of the bottom surface 13 of the display base 11 to enclose the bottom surface 13 of the display base 11 and to achieve the appearance of a solid wedge on the bottom surface 13 of the display device 10.

The slots 25-27 may extend fully across the bottom surface 13 of the base 11 or may terminate prior to meeting the adjoining surfaces 14-15, 19-20. The latitudinal panel 21 or the side panels 22-23 may extend fully across the bottom surface 13, but the preferred embodiment will achieve an L-shaped joint where the panel 21 meets the panels 22-23, as exemplified in FIG. 9. In the preferred embodiment the panels 21, 22, 23 project from the bottom surface at substantially perpendicular angles, the slots 25, 26, 27 having been arranged so as to receive panels 21, 22, 23 substantially orthogonally to the bottom surface 13. The panel 21 may, however, project from the bottom surface 13 at an oblique angle.

Figure 11:
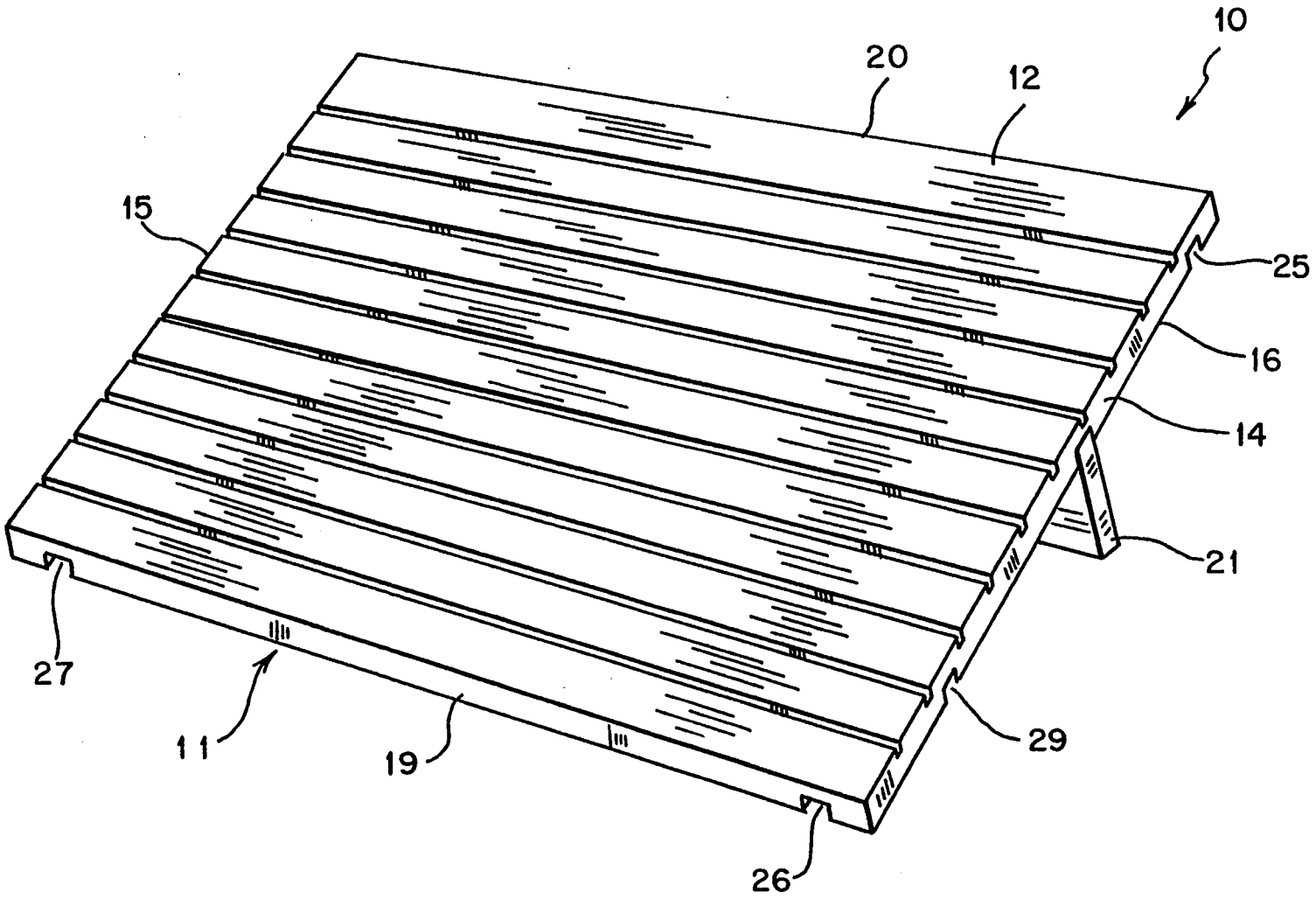
FIG. 11 is an elevated perspective view of the preferred display device utilizing the preferred support means in accordance with the invention.
Figure 12:
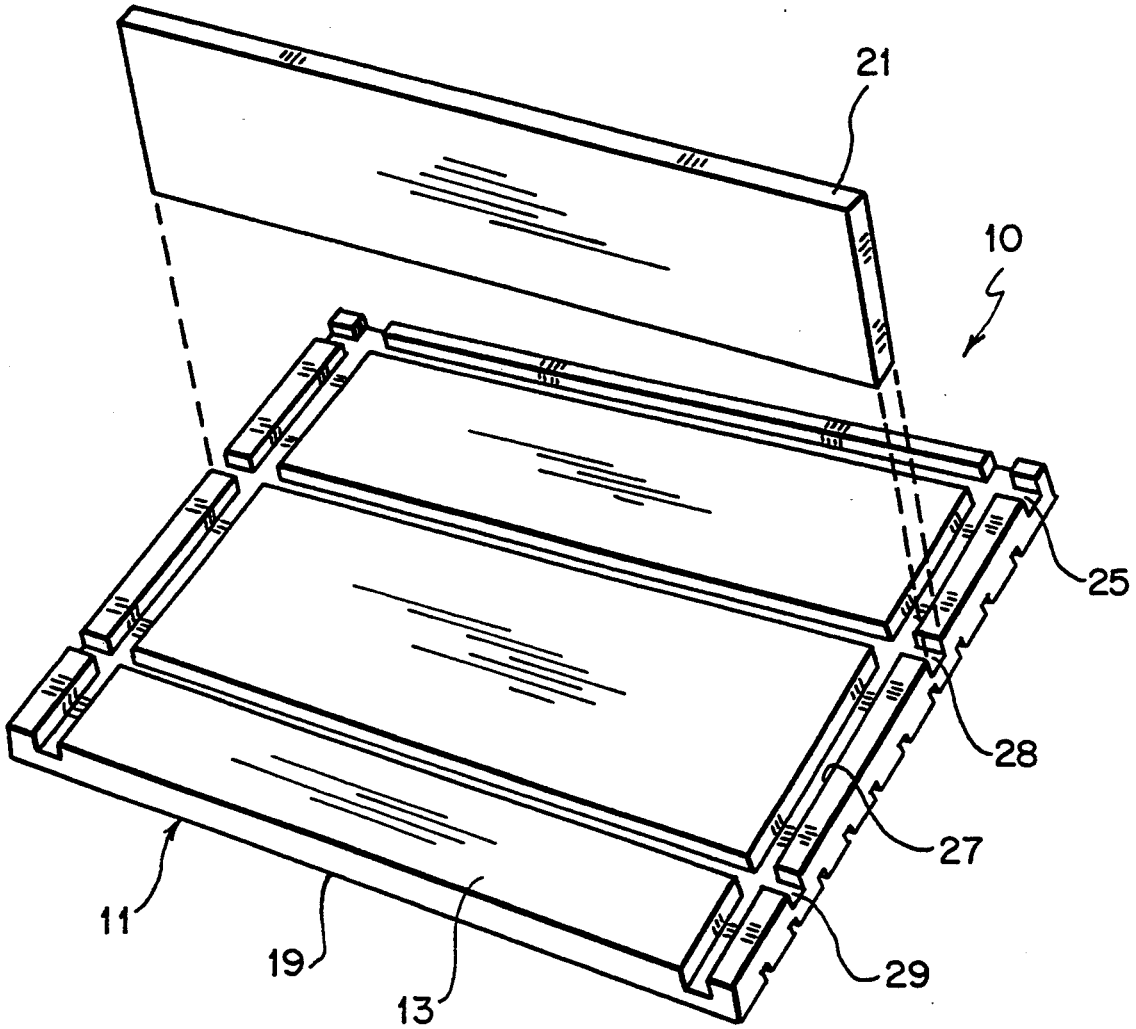
FIG. 12 is a bottom exploded perspective view thereof.
Figure 13:
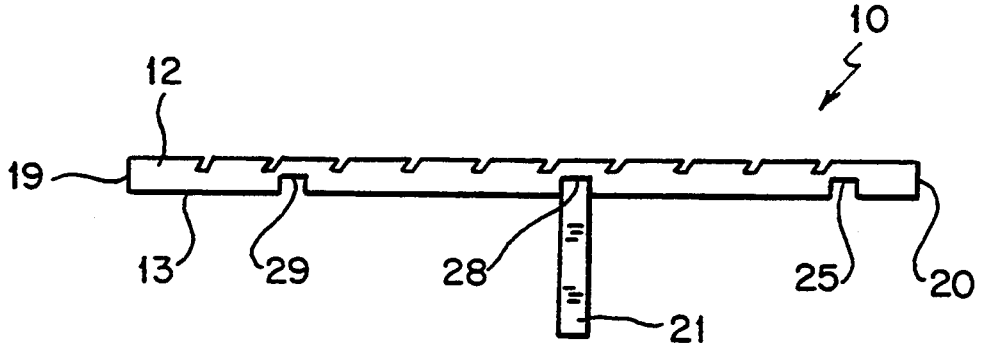
FIG. 13 is a right side elevational view thereof.

As illustrated in FIGS. 11–13, an alternative means of support is provided by one or more rectangular planar support panels 21 that fit into one or more linear slots 25, 28-29 on the bottom surface 13 of the display base 11. The linear slots 25, 28-29 may run in any direction, preferably parallel to the front and rear edges 19, 20 of the display base 11 and preferably substantially parallel to each other. If more than one rectangular support panels 21 are employed it is preferred that the panels 21 vary in height thereby imparting an incline to the base 11.

The slots 25, 28-29 may extend fully across the bottom surface 13 of the base 11, or may terminate prior to meeting the side surfaces 14, 15 of the base 11. The panel 21 may extend fully across the bottom surface 13 terminating flush with the side surfaces 14, 15, or may be of a length to fit within slots 25, 28-29 that terminate prior to meeting the side surfaces 14, 15. The panel 21, when affixed to the bottom surface 13 of the base 11, preferably projects therefrom at a substantially perpendicular angle, but may project at an oblique angle.

Figure 14:
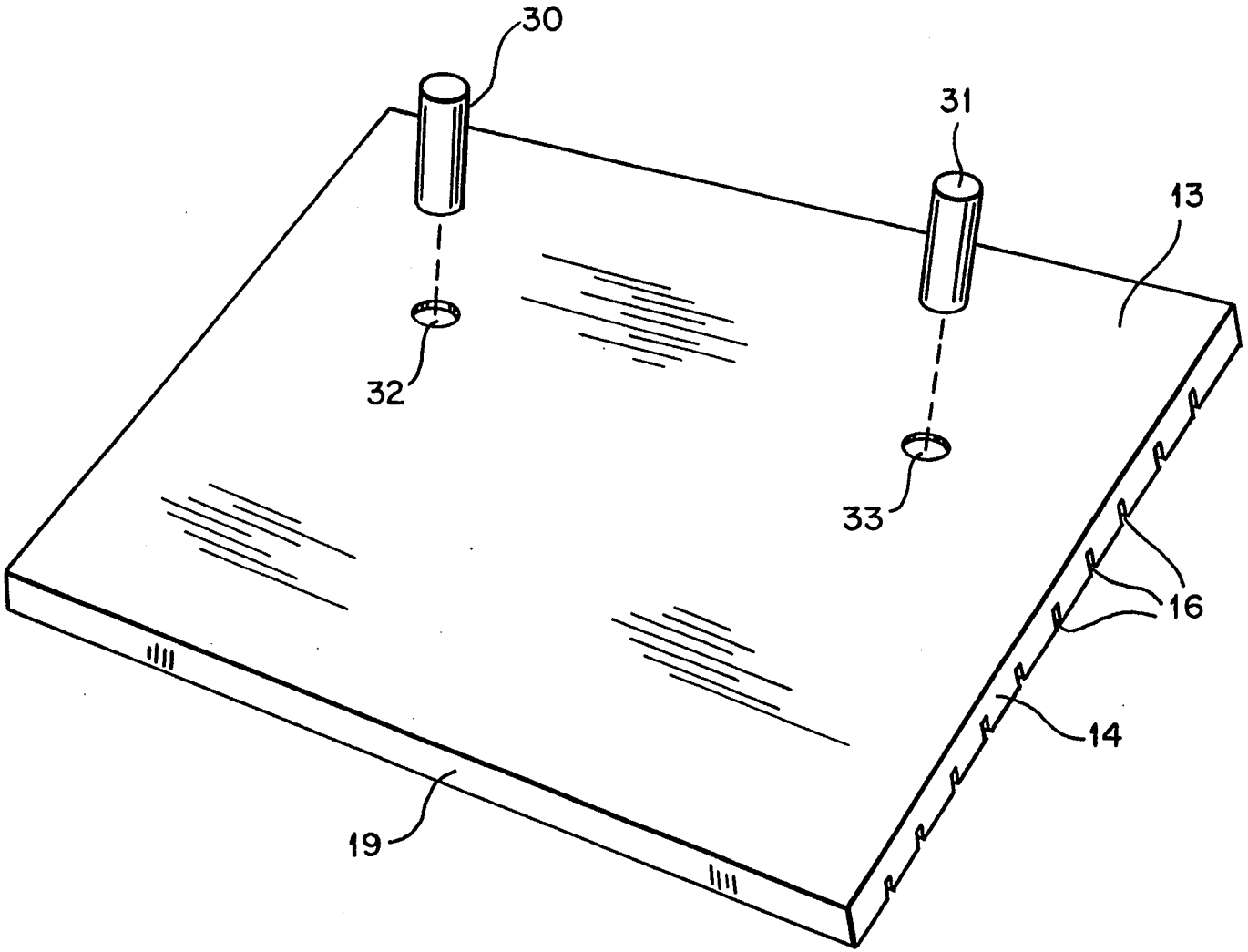
FIG. 14 is a bottom exploded perspective view of a display device utilizing alternative support means in accordance with the present invention.
Figure 15:
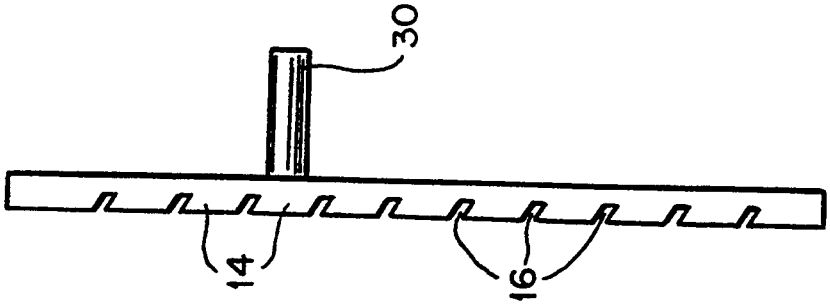
FIG. 15 is a right side elevational view thereof.

Alternatively, as illustrated in FIGS. 14 and 15, a pair of support posts 30, 31 may be mounted to the bottom surface 13 of the base 11 by means of insertion into holes 32, 33, to hold the base 11 in an inclined position when it is in use. In such a configuration, it is preferred that the posts project from the bottom surface 13 at a substantially perpendicular angle.

Figure 16:
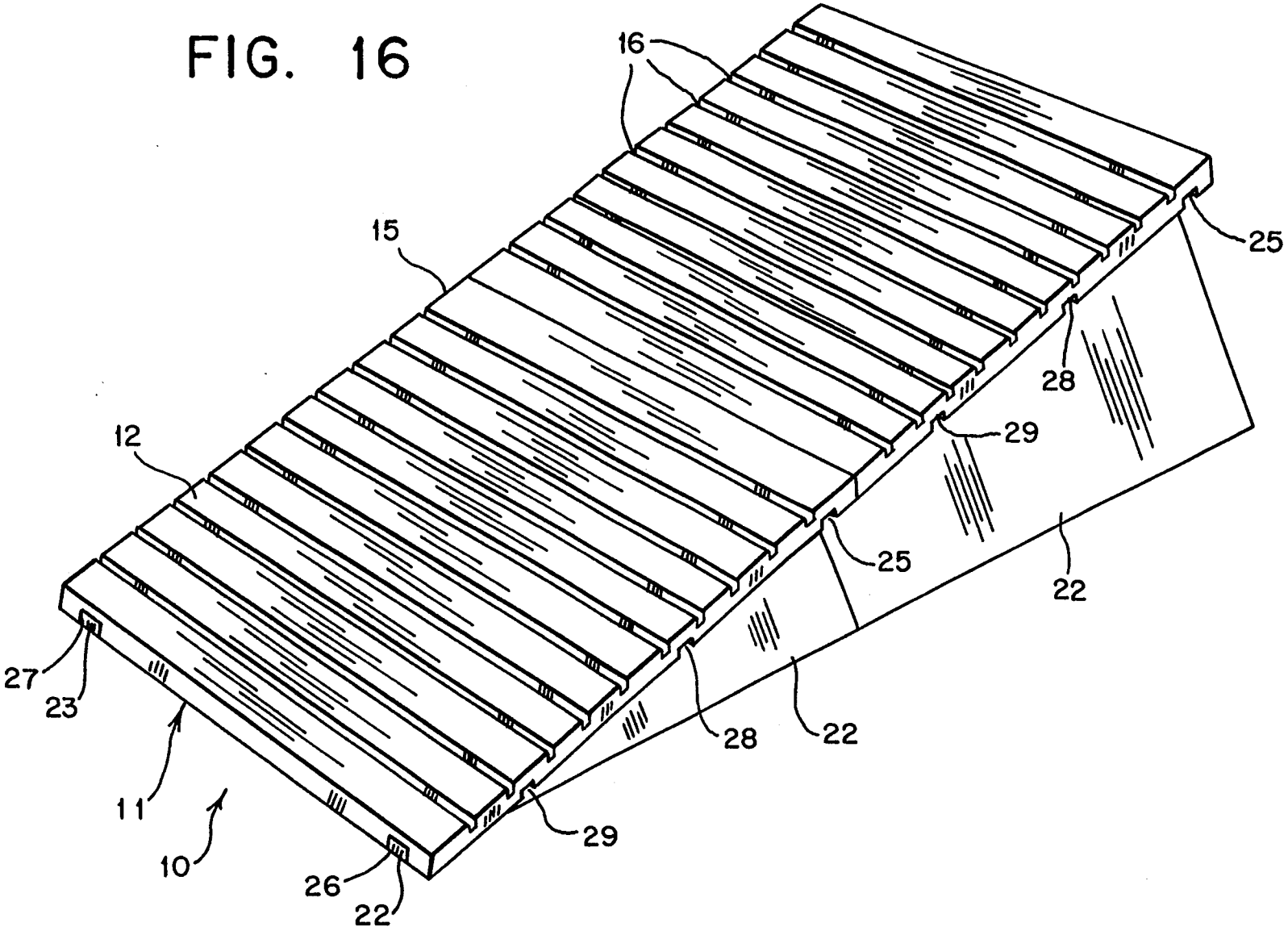
FIG. 16 is an elevated perspective view of two display devices utilized in modular, adjacent fashion in accordance with the present invention.
Figure 17:
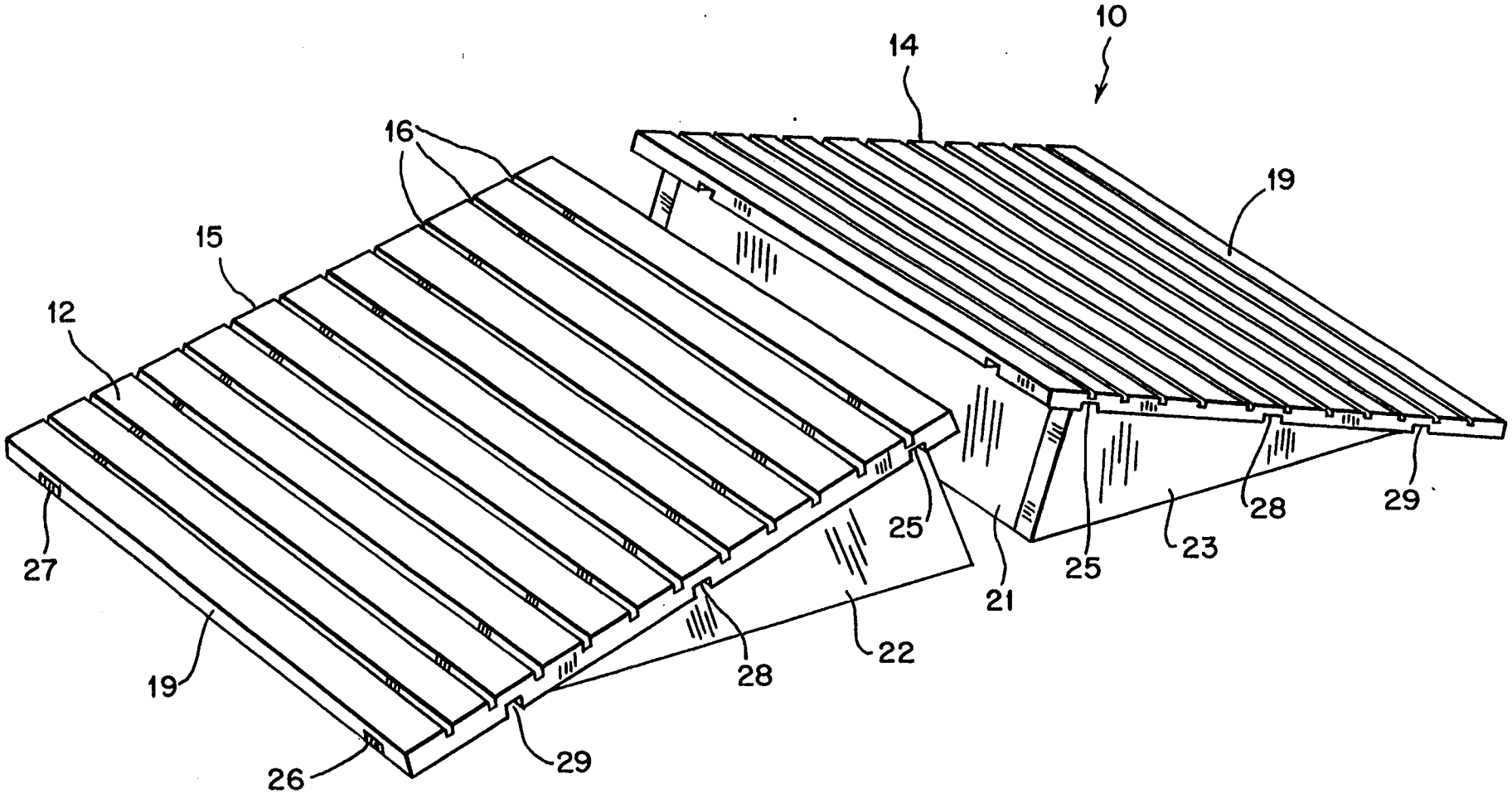
FIG. 17 is an elevated perspective view of two display devices utilized in modular, adjacent fashion in accordance with the present invention.
Figure 18:
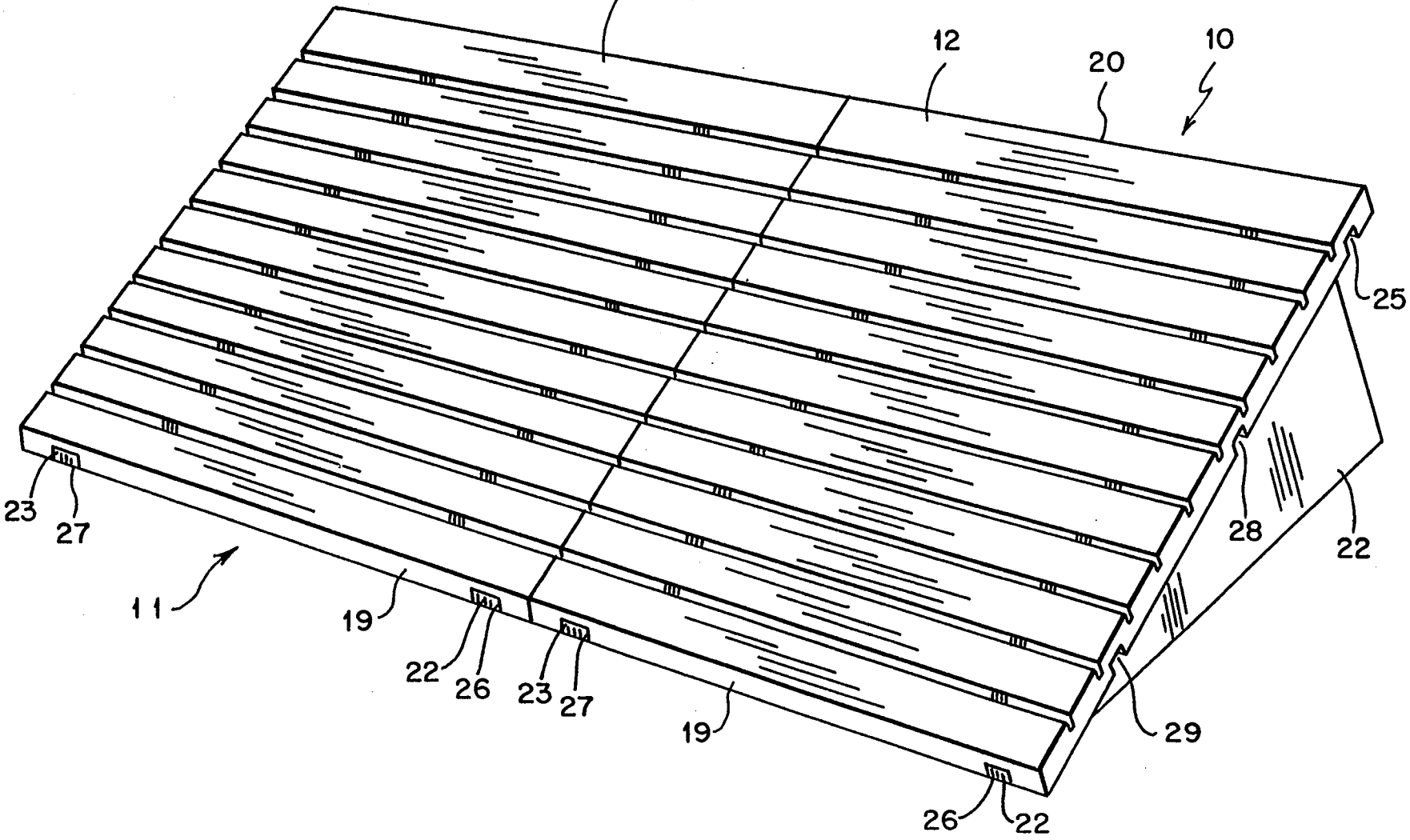
FIG. 18 is an elevated perspective view of two display devices utilized in modular, adjacent fashion in accordance with the present invention.

As illustrated by FIGS. 16–18, it is contemplated that more than one display device 10 may be joined or juxtaposed as a modular system that allows upgrading or expanding to accommodate a variety of display items 40. A multitude of display devices 10 may be joined together permanently or temporarily, using dedicated hardware, including but not limited to panels, adapters, pins, slots or frames at the side surfaces 14, 15, front 19 or back 20 surfaces or at the base 11. By means of such adapting hardware, a basic table top model may be easily adapted to a wall or floor stand enabling expanded display possibilities. Display devices 10 employed in such a modular fashion are generally not restricted to a preferred wedge support means as illustrated in FIGS. 16–18, but may employ alternative support means as described herein.

Two or more display devices 10, employing a preferred wedge support means comprising panels 21-23, may be juxtaposed in an in-line, back to back, or side by side modular system, as illustrated in FIGS. 16–18 respectively. Alternatively, the panels 21-23 and the display base 11 may be modified so that the devices 10 used in a back to back, side by side or in-line configuration will together give the appearance of a single device. In a back to back configuration, the modified devices 10 will give the appearance of a single device having two display surfaces and a substantially isosceles triangular cross-section.

Figure 19:
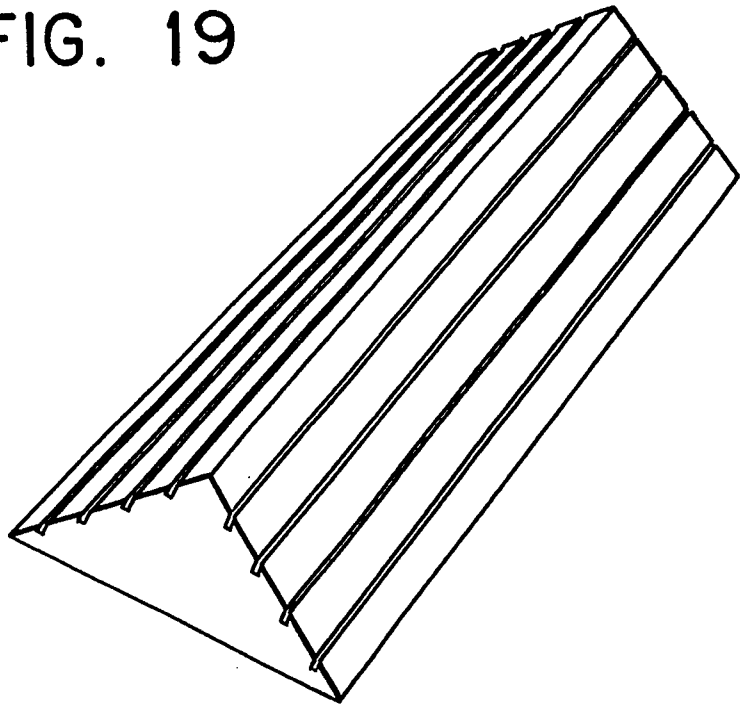
FIG. 19 is an elevated perspective view of the preferred two-sided display device in accordance with the present invention.
Figure 21:
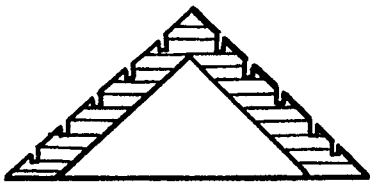
FIG. 21 is a side-elevational view thereof.
Figure 20:
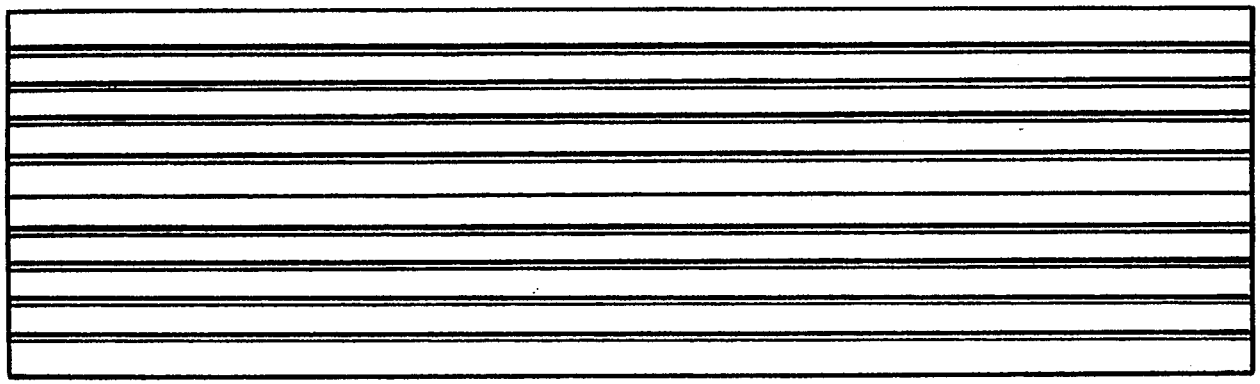
FIG. 20 is a top plan view thereof.

Another embodiment, as exemplified in FIGS. 19–21 may be an elongated tubular device with a square, rectangular, triangular, semicircular, or cylindrical cross-section. The device in this embodiment may be solid or use supporting means giving the device the appearance of being solid. This embodiment offers the advantage of a two-sided display surface that allows for the insertion of display items in a back to back configuration enabling viewing of items from two opposite sides. This embodiment may further offer the advantage of conserving mounting surface space requirements.

The display device 10 may be constructed of various solid substances, including, but not limited to woods, plastics, acrylics, glass, stone, and metals, and may be carved, cut, or molded by injection molding or other molding process, and may have a diversity of appearances, finishings, or trimmings including internal or external lighting or embellishments. Panels may be designed for various occasions, decors, or environments. The depth and angles of the slots 16 may vary to achieve a diversity of display options.

As described herein before, the display device in accordance with the present invention may be employed as an organizing display device for business cards, credit cards, membership cards or other types of smaller items. This embodiment may consist of a display base of from about 2 inches to about 5 inches across, preferably from about 2½ inches to about 4 inches across, and from about 4 inches to about 20 inches deep, preferably from about 6 inches to about 12 inches deep. This embodiment may employ any of the support means described in detail elsewhere in this specification. The smaller dimensions of this embodiment may render it well suited for use on desk tops, tables, file cabinets, and other locations where simultaneous viewing of items of these kinds is desired. However, desirably longer or wider versions of this embodiment may be used to accomodate a larger number of items or larger items.

In addition, the described display device may be suitable as an organizing device for various purposes. Specifically, two or more portions of a single display device, as well as the entireties of two or more individual devices used in modular fashion, could be configured to indicate the status or preference of various displayed items. For example, a single display device may be used for the purpose of monitoring attendance of employees or associates wherein the surface of the display device has been marked so as to create two separate categories: "In" and "Out". Individual cards containing the names of persons may be easily moved around to indicate their attendance status.

Other variations on this embodiment may include defining separate portions of a device or separate tandem devices for the categories: Yes/No; Repaired/Not Repaired; Do Not Disturb/Disturb; Urgent/Not Urgent, etc. Alternatively, display devices or portions thereof could be labeled with names of persons and used as an organizing message center.

The described display device may also be suitable for the hotel or restaurant industry where guests names appear on cards, and the illustrated display device might be usefully employed to simultaneously organize and display the cards according to, for example, seating or attendance information.

Alternatively, the described display device may be suitable for organizing and displaying photographs. For example, 8"×10" portrait photographs, common in the modeling industry, may be organized and displayed on a desk, table, wall or similar surface, and the sequence of the photographs may be constantly altered at the will of the viewer. This organized and simultaneous viewing of such photographs is preferable to having the photographs randomly strewn across a desk.

Another embodiment suitable for organizing and viewing photographic negatives, slides, and the like may include lighting or magnifying features to illuminate and facilitate viewing of the negatives or slides. For example, such embodiment may be made from transparant or translucent material with internal lighting and photographic negatives or slides may be placed in one slot while a magnifying surface may be placed in one or more slots in front of the negative or slide.

Thus, while I have described what are presently the preferred embodiments of the present invention, other and further changes and modifications could be made without departing from the scope of the invention, and it is intended by the inventor to claim all such changes and modifications.

I claim:

1. A device for holding and displaying greeting cards, photographs, sports memorabilia and other self-supporting card shaped objects, comprising:

a display device including a solid object having predetermined dimensions, said solid object having at least one planar display surface;

said planar display surface having a plurality of slots extending fully across a width dimension of said planar display surface, said slots are open across an entire width dimension of the display device and having a width dimension and a depth dimension suitable for holding a substantially self-supporting flat object at a substantially vertical orientation with regard to gravity;

support means attached to a surface opposite said display surface for placing said planar display surface at an incline from the horizontal orientation with regard to gravity; and wherein said slots are oriented at an angle from greater than 0° to about 5° towards a rear surface of said solid object measured from said vertical orientation with regard to gravity.

2. A display device as recited in claim 1 having two latitudinally elongated and substantially symmetrical display surfaces as defined relative to an imaginary plane oriented vertically relative to gravity, each of said display surfaces having a plurality of slots the openings of which are oriented substantially parallel to said imaginary plane, and each of said slots being inclined at an angle of from greater than 0° to about 5° toward said imaginary plane as measured from the vertical orientation with regard to gravity.

3. A display device as recited in claim 2 wherein said display device has a substantially isosceles triangular cross-section.

4. A display device according to claim 1, wherein said depth is from about 3 mm to about 7 mm.

5. A display device according to claim 1, wherein said slots are oriented in a desired design or pattern.

6. A display device according to claim 5, wherein said slots are oriented substantially parallel to each other.

7. A display device according to claim 1, wherein said planar surface includes from about 1 to about 15 slots.

8. A display device as recited in claim 1, wherein said planar surface includes from about 5 to about 15 slots.

9. A display device as recited in claim 1, wherein said solid object has a shape selected from the group consisting of rectangular, square, round, oval, curved, triangular, wedged, heart-shaped, cylindrical, conical, polygonal and irregularly shaped.

10. A display device as recited in claim 9 wherein said shape is rectangular.

11. A display device as recited in claim 1, wherein said support means places said planar surface at an incline from the horizontal of from about 1° to about 90°.

12. A display device as recited in claim 11, wherein said support means is selected from the group consisting of support panels, and posts.

13. A display device as recited in claim 1, wherein said support means places said planar surface at an incline from the horizontal of from about 5° to about 30°.

14. A display device as recited in claim 13, wherein said support means is selected from the group consisting of support panels, or posts, connected to said opposite surface of said solid object.

15. A display device as recited in claim 1, wherein said display device comprises a plurality of said solid objects connected to each other modularly by at least one of their sides.

16. A display device as recited in claim 1, wherein said width dimension of said planar display surface is larger than a length dimension of said planar display surface.

* * * * *